US009601068B2

(12) United States Patent
Zhang

(10) Patent No.: US 9,601,068 B2
(45) Date of Patent: Mar. 21, 2017

(54) LIQUID CRYSTAL DISPLAY CONTROL METHOD AND SYSTEM, AND DISPLAY DEVICE

(71) Applicant: BOE TECHNOLOGY GROUP CO., LTD., Beijing (CN)

(72) Inventor: Kailiang Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 279 days.

(21) Appl. No.: 14/477,619

(22) Filed: Sep. 4, 2014

(65) Prior Publication Data

US 2015/0364095 A1 Dec. 17, 2015

(30) Foreign Application Priority Data

Jun. 13, 2014 (CN) ..... 2014 1 0266053

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/3611* (2013.01); *G09G 3/3426* (2013.01); *G09G 2320/0646* (2013.01)

(58) Field of Classification Search

CPC ..... G09G 3/3406; G09G 2330/021

(Continued)

(56) References Cited

U.S. PATENT DOCUMENTS

2009/0267926 A1* 10/2009 Seo ..... G09G 3/3426 345/204
2009/0290091 A1* 11/2009 Tsuchida ..... G09G 3/3426 349/61

(Continued)

FOREIGN PATENT DOCUMENTS

CN 101727843 A 6/2010
CN 102016699 A 4/2011

(Continued)

OTHER PUBLICATIONS

Chinese Office Action and English translation dated Nov. 19, 2015, for corresponding Chinese Application No. 201410266053.8.

*Primary Examiner* — Calvin C Ma
(74) *Attorney, Agent, or Firm* — Kinney & Lange, P.A.

(57) ABSTRACT

Disclosed are liquid crystal display control method and system, and a display device. The liquid crystal display control method comprises: performing a decoding operation on input video signals to obtain data corresponding to respective pixels of a display panel; dividing the display panel into a plurality of display regions so that each display region corresponds to one or more light sources of a backlight source and a symmetric center of the one or more light sources is positioned such that an orthographic projection thereof on the display panel is coincided with a center of the corresponding display region; calculating a control signal for controlling display of each display region based on the data corresponding to pixels in the display region; redividing each display region into a plurality of subregions based on a light distribution in the display region and regulating the control signal for controlling the display of each subregion based on data corresponding to pixels in the subregion; and controlling the display panel and the backlight source based on the regulated control signals.

20 Claims, 4 Drawing Sheets

(58) Field of Classification Search
USPC ..... 345/102, 590, 690–691
See application file for complete search history.

(56) References Cited

U.S. PATENT DOCUMENTS

| | | | | |
|---|---|---|---|---|
| 2011/0134158 | A1* | 6/2011 | Onishi | G09G 3/3426 345/690 |
| 2012/0287146 | A1 | 11/2012 | Brown Elliott et al. | |

FOREIGN PATENT DOCUMENTS

| | | | |
|---|---|---|---|
| CN | 102098830 | A | 6/2011 |
| CN | 102103840 | A | 6/2011 |
| CN | 102298908 | A | 12/2011 |

* cited by examiner

LIQUID CRYSTAL DISPLAY CONTROL METHOD AND SYSTEM, AND DISPLAY DEVICE

CROSS-REFERENCE TO RELATED APPLICATION

This application claims the benefit of Chinese Patent Application No. CN201410266053.8 filed on Jun. 13, 2014 in the State Intellectual Property Office of China, the whole disclosure of which is incorporated herein by reference.

BACKGROUND OF THE INVENTION

Field of the Invention

Embodiments of the present invention generally relate to field of display technique, and in particular to liquid crystal display control method and system, and a display device.

Description of the Related Art

With the development of liquid crystal display technique, a liquid crystal display device such as a liquid crystal television is used widely, and the size thereof becomes larger, which provides new visual enjoyment to users.

The liquid crystal display device is a passive display device using a backlight source, power consumption of which has a highest ratio in whole power consumption of the liquid crystal display device. For a direct-light type backlight source, in order to reduce the power consumption, a display panel is generally divided into a plurality of regions, and brightness of the backlight source in each region is controlled by analyzing display signals to realize a reduction in the power consumption of the liquid crystal display device.

However, a size of a single divided region is much larger than one pixel of the liquid crystal display panel and distribution of light in the single divided region is not uniform. Further, after dividing the display panel into regions, brightness of one region is affected not only by a light source directly below the one region but also by light sources below eight adjacent regions therearound, as shown in FIG. 1. Therefore, controlling brightness in each region by existing region control methods for backlight sources based on a predetermined value may cause a large difference in brightness between adjacent regions, thereby affecting user's viewing.

SUMMARY OF THE INVENTION

The present invention has been made to overcome or alleviate at least one aspect of the above mentioned disadvantages.

According to an aspect of the present invention, there is provided liquid crystal display control method, comprising steps of:

performing a decoding operation on input video signals to obtain data corresponding to respective pixels of a display panel;

dividing the display panel into a plurality of display regions, so that each display region corresponds to one or more light sources of a backlight source and a symmetric center of the one or more light sources is positioned such that an orthographic projection thereof on the display panel is coincided with a center of the corresponding display region;

calculating a control signal for controlling display of each display region based on the data corresponding to pixels in the display region;

redividing each display region into a plurality of subregions based on a light distribution in each display region, and regulating the control signal for controlling display of each subregion based on data corresponding to pixels in the subregion; and controlling the display panel and the backlight source based on the regulated control signals.

According to another aspect of the present invention, there is provided liquid crystal control system, comprising:

a decoder configured to perform a decoding operation on input video signals to obtain data corresponding to respective pixels of a display panel;

a region signal processing means, configured to divide the display panel into a plurality of display regions so that each display region corresponds to one or more light sources of a backlight source and a symmetric center of the one or more light sources is positioned such that an orthographic projection thereof on the display panel is coincided with a center of the corresponding display region, and configured to calculate a control signal for controlling display of each display region of the display panel based on the data corresponding to pixels in the display region;

a subregion signal processing means configured to redivide each display region into a plurality of subregions based on a light distribution in each display region and regulate the control signal for controlling display of each subregion based on data corresponding to pixels in the subregion; and a control means configured to control the display panel and the backlight source based on the regulated control signals.

According to a yet another aspect of the present invention, there is provided a liquid crystal display device, comprising:

a display device;

a backlight source; and the liquid crystal display control system as described above, for controlling the display panel and the backlight source.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
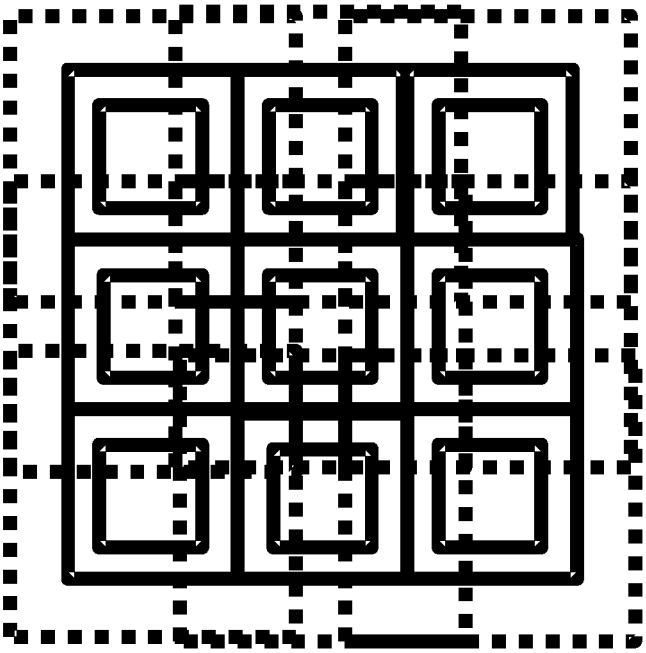
FIG. 1 is an illustrative view showing an interrelationship between light sources of a backlight source in respective regions of a display panel of a liquid crystal display device.

Exemplary embodiments of the present disclosure will be described hereinafter in detail with reference to the attached drawings In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
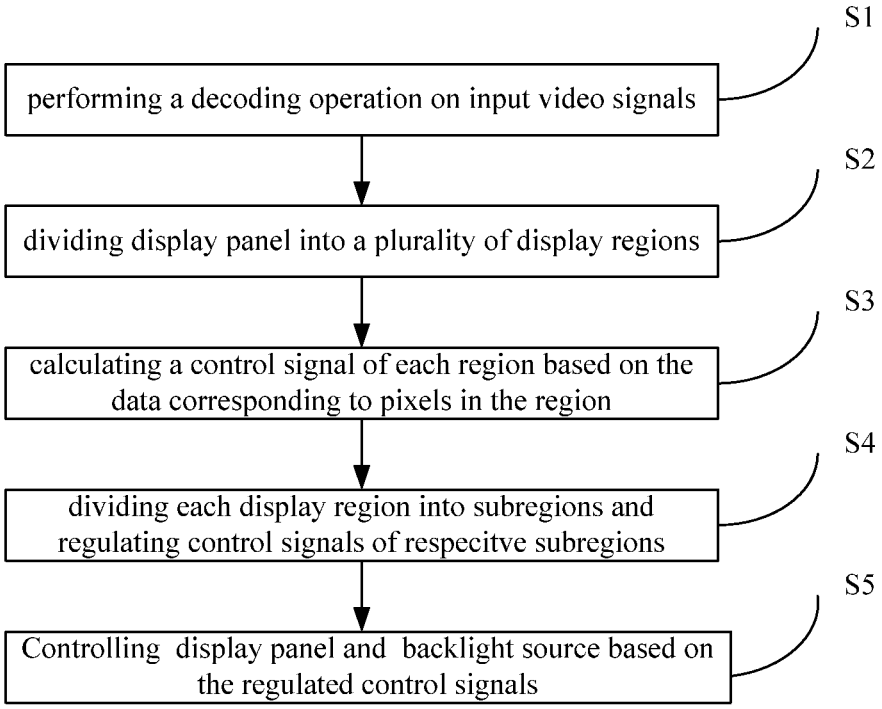
FIG. 2 is a flow chart showing a liquid crystal display control method according to an exemplary embodiment of the present invention.

FIG. 2 illustrates a flow chart of a liquid crystal display control method according to an exemplary embodiment of the present invention. As shown in FIG. 2, the liquid crystal display control method may comprise following steps of:

S1: performing a decoding operation on input video signals to obtain data corresponding to respective pixels in a display panel. The data may be 6, 8 or 10 bit data.

S2: dividing the display panel into a plurality of display regions. Unlike exist methods in which the display panel is simply and uniformly divided into a plurality of display regions, in the liquid crystal display control method according to the exemplary embodiment of the present invention, the display panel can be divided into the plurality of display regions, so that each display region corresponds to one or more light sources of backlight sources and a symmetric center of the one or more light sources is positioned so that an orthographic projection thereof on the display panel is coincided with a center of the corresponding display region, i.e., aligned with the center of the corresponding display region in a direction along which the display panel is superposed on the backlight source. For a direct-light type liquid crystal display device, a plurality of LED light sources are generally distributed uniformly below the display panel. In this case, the symmetric center of the one or more light sources corresponding to each display region is positioned directly below the center of the display region. As can be appreciated by those skilled in the art, the symmetric center may be located directly above, front or behind the center of the corresponding display region based on the orientation of the liquid crystal device.

Figure 3:
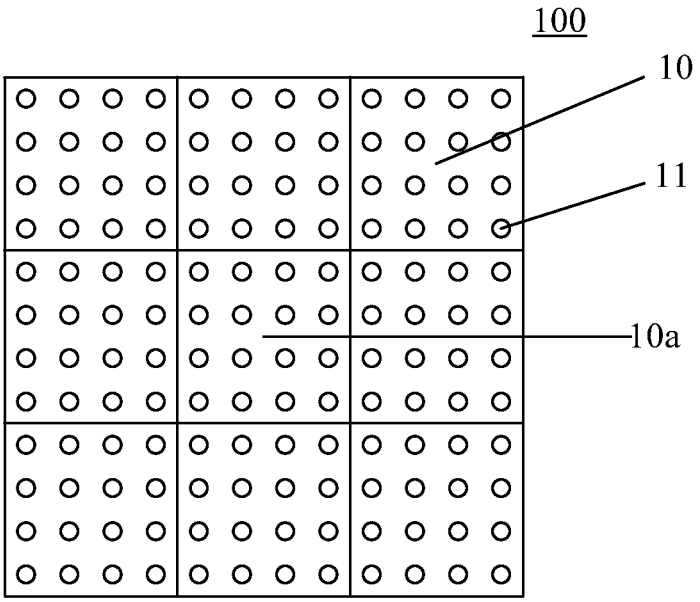
FIG. 3 is an illustrative view showing a division of regions of a display panel of a display device according to an exemplary embodiment of the present invention.

As illustrated in FIG. 3, in the control method of liquid crystal display according to an exemplary embodiment of the present invention, the display panel 100 may be divided into a plurality of square display regions 10. FIG. 3 only schematically illustrates 9 square display regions 10. However, it is possible to divide the display panel into more or less regions according to a specific size of the display panel. In an exemplary example, each of the display regions may correspond to n×n LED light sources of the backlight source, wherein n is an integer equal to or greater than 1. 8×8 LED light sources are generally selected to correspond to the center of the divided display regions, the present invention, however, is not limited thereto. In order to obtain a finer control, it is also possible to select 4×4 or 2×2 or even one LED light source as the center to divide the display regions. Of course, it should be appreciated by those skilled in the art that the divided display regions are not always squares, and the square display region as an example is only used to provide the best illustration of the principles of the present invention and is not limit the present invention to particular form disclosed. The divided display region may also be rectangular or polygonal such as triangular, rhombic, pentagonal, hexagonal or the like.

S3: calculating a control signal for controlling display of each display region based on the data corresponding to pixels in the display region. Calculating the control signal may particularly comprise calculating a maximum pixel value of each display region of the display panel based on the data corresponding to pixels in the display region and obtaining regulated pixel values and a regulated backlight brightness value for the display region based on the calculated maximum pixel value. More particularly, after calculating the maximum pixel value of each display region of the display panel based on the data corresponding to pixels in the display region, the method may further comprise: calculating a pixel value regulation coefficient of each display region based on the maximum pixel value of the display region, and calculating the regulated pixel values based on the pixel value regulation coefficient; and calculating a backlight brightness regulation coefficient for each display region based on the maximum pixel value of the display region and calculating the regulated backlight brightness value based on the backlight brightness regulation coefficient.

S4: redividing each display region into a plurality of subregions based on a light distribution in the display region and regulating the control signal for controlling display of each subregion based on the data corresponding to pixels in the subregion. The step of redividing may particularly comprise calculating a maximum pixel value of each subregion based on the data corresponding to pixels in the subregion and obtaining regulated pixel values and a regulated backlight brightness value for each subregion based on the calculated maximum pixel value of the subregion. More particularly, after calculating the maximum pixel value of each subregion based on the data corresponding to pixels in the subregion, the method may further comprise: calculating a pixel value regulation coefficient for each subregion based on the maximum pixel value of the subregion, and calculating the regulated pixel values based on the pixel value regulation coefficient; calculating a backlight brightness regulation coefficient for each subregion based on the maximum pixel value of the subregion and calculating the regulated backlight brightness value based on the backlight brightness regulation coefficient.

S5: controlling the display panel and the backlight source based on the regulated control signals. Particularly, the regulated pixel values may be transmitted to a liquid crystal driving circuit to control the display of the liquid crystal display panel according to associated protocols, and the regulated backlight brightness values may be transmitted to a backlight driving circuit to control brightness of the backlight source according to communications protocols of the backlight driving circuit such as SPI, IIC or the like.

The liquid crystal display control method according to an exemplary embodiment of the present invention will be described in detail below with reference to specific examples.

Figure 4:
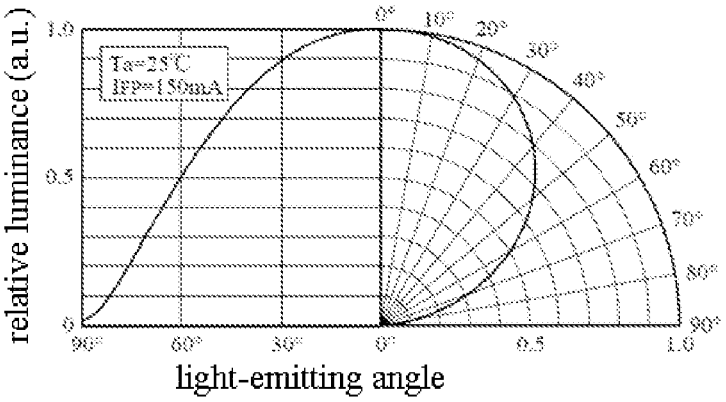
FIG. 4 is a graph showing a brightness of light emitted by one LED light source as a light-emitting angle varies.
Figure 5:
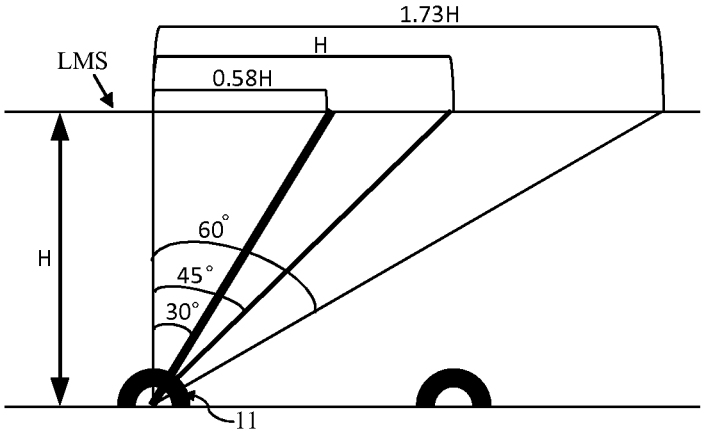
FIG. 5 is an illustrative view showing a relationship between the light-emitting angle of a light source and a distance from the light source.

FIG. 4 is a graph showing a brightness of light emitted by one LED light source as a light-emitting angle varies. As depicted in FIG. 4, for one LED light source, as the light-emitting angle varies, the brightness of the light is decreased gradually. The brightness of the light at the light-emitting angle of 30° is 90% of the brightness at the center of the LED light source, at the light-emitting angle of 45° is 85% of the brightness at the center of the LED light source, and at the light-emitting angle of 60° is 50% of the brightness at the center of the LED light source. FIG. 5 illustrates a relationship between the light-emitting angle of a light source and a distance from the light source. In a case where the plurality of LED light sources of the backlight source are arranged in a dot array, as shown in FIG. 5, a ratio of a distance between adjacent LED light sources 11 to a light mixing height is set as 1:1, i.e., the light mixing height is H and the distance between the adjacent LED light sources 11 is also H. Therefore, as indicated in the graph representing a relationship between the light-emitting angle and the brightness shown in FIG. 4, when distances from the center of the LED light source 11 are 0.58 H, H and 1.73 H at the light-emitting angles of 30°, 45° and 60° on a light mixing surface LMS, respectively, the brightness of light at the corresponding light-emitting angles are 90%, 85% and 50% of the brightness at the center of the LED light source 11.

Figure 6:
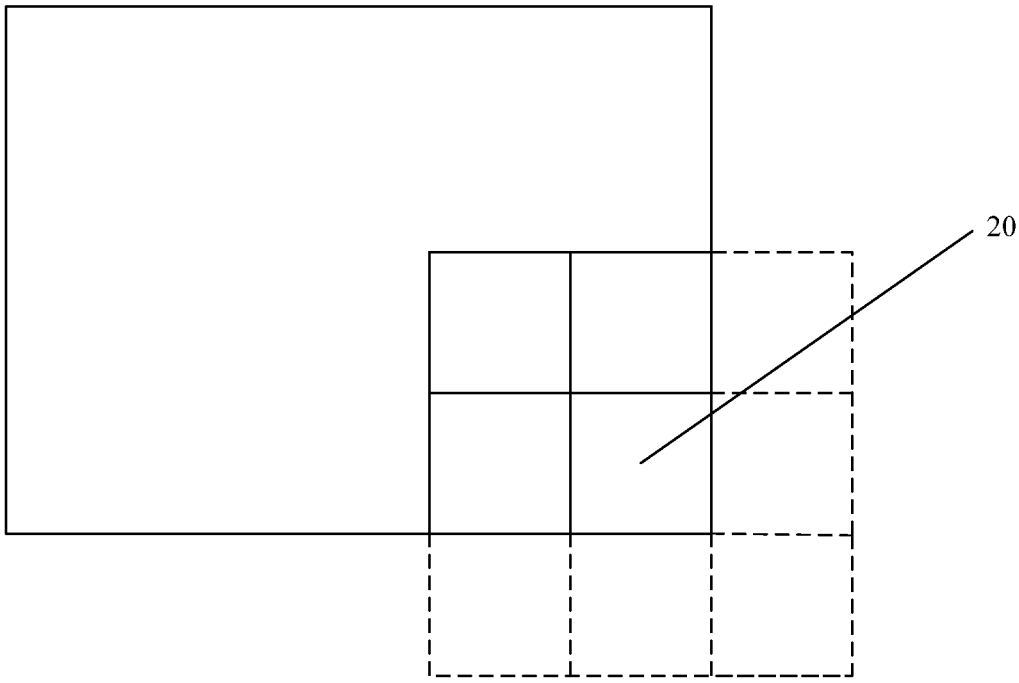
FIG. 6 is an illustrative view showing a region dividing model of a display region at a margin of the display panel of the display device.

After the entire display panel of the liquid crystal display device is divided into a plurality of square display regions, control signals of these display regions may be obtained using various known methods. It is possible to select one display region as a researching object from the plurality of display regions divided. For example, when the square display region 10*a* in FIG. 3 is selected as the researching object, there are eight display regions which are associated with the square display region 10*a* in brightness and adjacent thereto. For a zone at a margin of the display panel of the display device, although no other square region is provided outside of and around the zone, this zone may be researched based on a mirror reflection and its mathematical model is same as that shown in FIG. 3 since a side surface of the backlight source uses a reflective material. As illustrated in FIG. 6, taking the square region 20 at a corner of the display panel as an example, there are only three regions which are adjacent to the square region 20 on the display panel, and five regions such as those as indicated by broken lines in FIG. 6 may be mirror imaged from the square region 20. Therefore, all of the regions in the entire display panel may be calculated using the same mathematical model.

Figure 7:
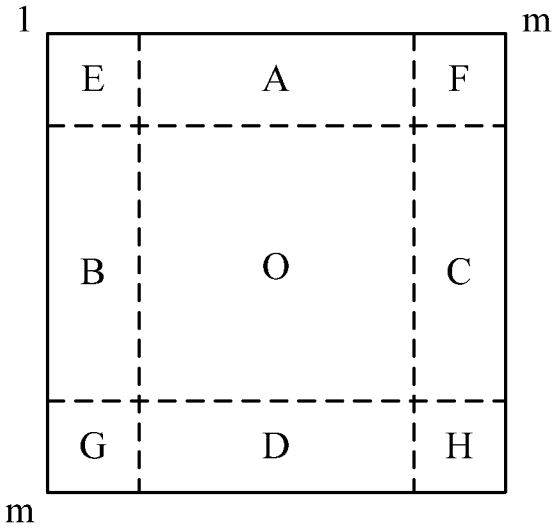
FIG. 7 is an illustrative view showing a division of subregions of a single display region.

In order to reduce an abrupt sense due to difference in brightness between the adjacent display regions, it is necessary to redivide each of the divided display regions. As shown in FIG. 7, the number of the pixels contained in each display region may be m×m, wherein m is an integer equal to or greater than 1. In each display region, a zone in which brightness of light from the LED light source corresponding to the display region is attenuated from a maximum brightness to 90% of the maximum brightness is divided as a first subregion, a distance of four sides of which from the center of the display region is 0.58 H. Further, zones in which the brightness of light from the LED light source corresponding to the display region is attenuated from 90% to 85% of the maximum brightness is divided as second subregions, i.e., eight subregions surrounding the first subregions, so as to obtain the first subregion O at the center and the second subregions A, B, C, D, E, F, G and H surrounding the first subregion O. The present invention, however, is not limited to this dividing principle for the subregions, and it is possible to divide the brightness more finely. For example, it is possible to divide one subregion per 1% brightness to finely control images.

In an exemplary example, assuming that a set maximum brightness of the LED backlight source is L, under this set maximum brightness, the maximum brightness of the first subregion is set as 2 L and the maximum brightness of the second subregions A to H is set as 1.85 L based on the regulated backlight brightness value of the corresponding display region.

Assuming that the pixel data is 8 bits and the maximum pixel values of the nine subregions, which are calculated based on the regulated pixel values of the corresponding display region, are M1, M2, M3, M4, M5, M6, M6, M8 and M9 respectively, backlight brightness regulation coefficients for respective subregions are M1/256, M2/256, M3/256, M4/256, M5/256, M6/256, M7/256, M8/256 and M9/256, respectively. The regulated backlight brightness values corresponding to the current image may be obtained by multiplying the set maximum brightness of each subregion by the backlight brightness regulation coefficients of respective subregions.

Each of the subregions may also be regulated correspondingly to ensure that the displayed images are not distorted. For one divided display region, the pixel value regulation coefficient of the first subregion O may be calculated to be 256/(M1/2+(M2+M3+M4+M5+M6+M7+M8+M9)/16), and the pixel value regulation coefficients of the second subregions A to F may be calculated to be 256/(M1*0.85/1.85+(M2+M3+M4+M5+M6+M7+M8+M9)/16) respectively, based on contributions of the respective subregions of the display region to the brightness of the display region. The regulated pixel values may be obtained by multiplying input pixel values of the respective subregions by the corresponding pixel value regulation coefficients respectively.

The regulated backlight brightness values are matched with the regulated pixel values to obtain a picture coinciding with an input image. Due to the reduction in backlight brightness, the whole power consumption of the display device will be decreased. Further, since the single display region is further divided, transition between the adjacent regions will be smoother, thus reducing users' abrupt sense when viewing.

Figure 8:
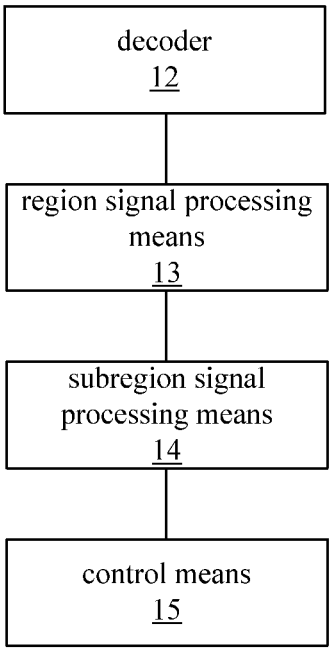
FIG. 8 is an illustrative view showing a liquid crystal display control system according to an exemplary embodiment of the present invention.

FIG. 8 is a schematic view showing a liquid crystal display control system according to an exemplary embodiment of the present invention. The liquid crystal display control system according to the present embodiment may comprise a decoder 12, a region signal processing means 13, a subregion signal processing means 14 and a control means 15.

According to an exemplary example, the decoder 12 is configured to perform a decoding operation on input video signals to obtain data corresponding to respective pixels in a display panel. The region signal processing means 13 is configured to divide the display panel into a plurality of display regions so that each display region corresponds to one or more light sources of a backlight source and a symmetric center of the one or more light sources is positioned such that an orthographic projection thereof on the display panel is coincided with a center of the corresponding display region, and is configured to calculate a control signal for controlling display of each display region of the display panel based on the data corresponding to pixels in the display region. The subregion signal processing means 14 is configured to redivide each display region into a plurality of subregions based on a light distribution in the display region and regulate the control signal for controlling display of each subregion based on data corresponding to pixels in the subregion. The control means 15 is configured to control the display panel and the backlight source based on the regulated control signals.

Further, the region signal processing means 13 may comprise a region dividing module configured to divide the display panel, a region maximum pixel value calculating module configured to calculate a maximum pixel value of the each display region of the display panel based on the data corresponding to pixels in the display region, a region pixel value regulating module configured to calculate a pixel value regulation coefficient of each display region based on the maximum pixel value of the display region and calculate regulated pixel values for each display region based on the pixel value regulation coefficient, and a region backlight brightness regulating module configured to calculate a backlight brightness regulation coefficient of each display region based on the maximum pixel value of the display region and calculate a regulated backlight brightness value for the display region based on the backlight brightness regulation coefficient.

According to an exemplary example, the subregion signal processing means 14 may comprise a subregion dividing module configured to redivide each display region into a plurality of subregions based on a light distribution in the display region, a subregion maximum pixel value calculating module configured to calculate a maximum pixel value of each subregion based on the data corresponding to pixels in the subregion, a subregion pixel value regulating module configured to calculate a pixel value regulation coefficient of each subregion based on the maximum pixel value of the subregion and calculate regulated pixel values for the subregion based on the pixel value regulation coefficient, and a subregion backlight brightness regulating module configured to calculate a backlight brightness regulation coefficient of each subregion based on the maximum pixel value of the subregion and calculate a regulated backlight brightness value for the subregion based on the backlight brightness regulation coefficient.

In an exemplary example, the subregion dividing module may be configured to divide each display region into a first subregion and a plurality of second subregions. For example, the first subregion may be located at a center of each display region and the second subregions may include eight subregions surrounding the first subregion. As an example, the subregion dividing module may be configured to redivide each display region into a plurality of subregions based on an attenuation ratio of brightness of light from the corresponding one or more light sources in the display region, as described above with reference to the liquid crystal display control method according to the exemplary embodiments of the present invention.

The control means 15 may comprise a pixel value controlling module configured to control display of the display panel based on the regulated pixel values and a backlight brightness controlling module configured to control brightness of the backlight source based on the regulated backlight brightness values.

The liquid crystal display control system according to embodiments of the present invention may be applicable to various liquid crystal display device of large sizes, such as a liquid crystal display device with a direct-light type backlight source. In the liquid crystal display control method and system and the display device according to embodiments of the present invention, it is possible to further redivide each of the display regions of a display panel into a plurality of subregions and regulate respective pixels in each subregion based on different regulation coefficients, thereby the power consumption can be reduced, and the abrupt sense due to the difference in brightness between the adjacent regions can decreased so that the display is more natural.

Although several exemplary embodiments have been shown and described, it would be appreciated by those skilled in the art that various changes or modifications may be made in these embodiments without departing from the principle and spirit of the disclosure, the scope of which is defined in the claims and their equivalents.

What is claimed is:

1. A liquid crystal display control method, comprising steps of:

performing a decoding operation on input video signals to obtain data corresponding to respective pixels of a display panel;

dividing the display panel into a plurality of display regions, so that each display region corresponds to one or more light sources of a backlight source and a symmetric center of the one or more light sources is positioned such that an orthographic projection thereof on the display panel is coincided with a center of the corresponding display region;

calculating a control signal for controlling display of each display region based on the data corresponding to pixels in the display region;

redividing each display region into a plurality of subregions based on a light distribution in each display region so that as light-emitting angle varies, a brightness of light emitted from the respective light source is decreased gradually, and regulating the control signal for controlling display of each subregion based on data corresponding to pixels in the subregion; and controlling the display panel and the backlight source based on the regulated control signals.

2. The method according to claim 1, wherein the step of calculating the control signal comprises calculating a maximum pixel value of each display region based on the data corresponding to pixels in the display region and obtaining regulated pixel values and a regulated backlight brightness value for the corresponding display region based on the calculated maximum pixel value.

3. The method according to claim 2, wherein the step of obtaining the regulated pixel values and the regulated backlight brightness value comprises:

calculating a pixel value regulation coefficient of each display region based on the maximum pixel value of the display region and calculating the regulated pixel values based on the pixel value regulation coefficient; and calculating a backlight brightness regulation coefficient of each display region based on the maximum pixel value of the display region and calculating the regulated backlight brightness value based on the backlight brightness regulation coefficient.

4. The method according to claim 1, wherein the step of redividing each display region into a plurality of subregions comprises dividing each display region into a first subregion located at a center of the display region and a plurality of second subregions surrounding the first subregion.

5. The method according to claim 4, wherein the plurality of second subregions of each display region comprises eight second subregions symmetrically arranged around the first subregion.

6. The method according to claim 1, wherein each display region is further redivided into a plurality of subregions based on an attenuation ratio of brightness of light from the corresponding one or more light sources in the display region.

7. The method according to claim 6, wherein a plurality of light sources of the backlight source are arranged in a dot array, a light mixing height of the light sources is H and a spacing between adjacent light sources is H; and the step of redividing each display region into a plurality of subregions comprises:

dividing a zone of the display region in which brightness light of from the corresponding one or more light sources is attenuated from a maximum brightness to 90% of the maximum brightness in the display region as a first subregion, a distance of a periphery of the first subregion from a center of the display region is 0.58H; and dividing zones of the display region in which brightness of light from the corresponding one or more light sources is attenuated from 90% to 85% of the maximum brightness in the display region as second subregions.

8. The method according to claim 1, wherein regulating the control signal comprises calculating a maximum pixel value of each subregion based on the data corresponding to pixels in the subregion and obtaining regulated pixel values and a regulated backlight brightness value for each subregion based on the calculated maximum pixel value of the subregion.

9. The method according to claim 8, wherein the step of obtaining the regulated pixel value and the regulated backlight brightness value comprises:

calculating a pixel value regulation coefficient for each subregion based on the maximum pixel value of the subregion and calculating the regulated pixel values based on the pixel value regulation coefficient; and calculating a backlight brightness regulation coefficient for each subregion based on the maximum pixel value of the subregion and calculating the regulated backlight brightness value based on the backlight brightness regulation coefficient.

10. The method according to claim 1, wherein each of the display regions comprises a square region, and the one or more light source corresponding to each display region comprises n×n light sources, wherein n is an integer equal to or greater than 1.

11. The method according to claim 1, wherein the regulated control signals comprises regulated pixel values and regulated backlight brightness values, and the step of controlling the display panel and the backlight source comprises controlling the display of the display panel based on the regulated pixel values and controlling the brightness of the backlight source based on the regulated backlight brightness values.

12. A liquid crystal control system, comprising:

a decoder configured to perform a decoding operation on input video signals to obtain data corresponding to respective pixels of a display panel;

a region signal processing means, configured to divide the display panel into a plurality of display regions so that each display region corresponds to one or more light sources of a backlight source and a symmetric center of the one or more light sources is positioned such that an orthographic projection thereof on the display panel is coincided with a center of the corresponding display region, and configured to calculate a control signal for controlling display of each display region of the display panel based on the data corresponding to pixels in the display region;

a subregion signal processing means configured to redivide each display region into a plurality of subregions based on a light distribution in each display region so that as a light-emitting angle varies, a brightness of light emitting from the respective light source is decreased gradually, and to regulate the control signal for controlling display of each subregion based on data corresponding to pixels in the subregion; and a control means configured to control the display panel and the backlight source based on the regulated control signals.

13. The liquid crystal control system according to claim 12, the region signal processing means comprises:

a region dividing module configured to divide the display panel into the plurality of display regions;

a region maximum pixel value calculating module configured to calculate a maximum pixel value of each display region of the display panel based on the data corresponding to pixels in the display region;

a region pixel value regulating module configured to calculate a pixel value regulation coefficient for each display region based on the maximum pixel value of the display region and calculate regulated pixel values for the display region based on the pixel value regulation coefficient; and a region backlight brightness regulating module configured to calculate a backlight brightness regulation coefficient for each display region based on the maximum pixel value of the display region and calculate a regulated backlight brightness value for the display region based on the backlight brightness regulation coefficient.

14. The liquid crystal control system according to claim 13, wherein the region dividing module is configured to divide each display region into a first subregion located at a center of the display region and a plurality of second subregions surrounding the first subregion.

15. The liquid crystal control system according to claim 12, wherein the subregion signal processing means comprises:

a subregion dividing module configured to redivide each display region into a plurality of subregions based on a light distribution in the display region;

a subregion maximum pixel value calculating module configured to calculate a maximum pixel value of each subregion based on the data corresponding to pixels in the subregion;

a subregion pixel value regulating module configured to calculate a pixel value regulation coefficient for each subregion based on the maximum pixel value of the subregion and calculate regulated pixel values for the subregion based on the pixel value regulation coefficient; and a subregion backlight brightness regulating module configured to calculate a backlight brightness regulation coefficient for each subregion based on the maximum pixel value of the subregion and calculate a regulated backlight brightness value for the subregion based on the backlight brightness regulation coefficient.

16. The liquid crystal control system according to claim 15, wherein the subregion dividing module is configured to further redivide each display region into a plurality of subregions based on an attenuation ratio of brightness of light from the corresponding one or more light sources in the display region.

17. The liquid crystal control system according to claim 16, wherein when a plurality of light sources of the backlight source are arranged in a dot array, a light mixing height of the light sources is H and a spacing between adjacent light sources is H, the subregion dividing module is configured to:

divide a zone of each display region in which brightness of light from the corresponding one or more light sources is attenuated from a maximum brightness to 90% of the maximum brightness in the display region as a first subregion, a distance of a periphery of the first subregion from a center of the display region is 0.58H; and divide zones of each display region in which brightness of light from the corresponding one or more light sources is attenuated from 90% to 85% of the maximum brightness in the display region as second subregions.

18. The liquid crystal control system according to claim 12, wherein the control means comprises:

a pixel value controlling module configured to control the display of the display panel based on the regulated pixel values; and a backlight brightness controlling module configured to control the brightness of the backlight source based on the regulated backlight brightness.

19. A liquid crystal display device, comprising a display device;

a backlight source; and the liquid crystal display control system according to claim 12, for controlling the display panel and the backlight source.

20. The liquid crystal display device according to claim 19, wherein the backlight source comprise a direct-light type backlight source.

* * * * *